US010723504B2

(12) United States Patent
Joshi et al.

(10) Patent No.: US 10,723,504 B2
(45) Date of Patent: Jul. 28, 2020

(54) HEAT SET CONTAINER WITH LABEL BOUNDARY PANEL

(75) Inventors: Rohit V. Joshi, Ann Arbor, MI (US); Nathaniel Haller, South Lyon, MI (US); James Stelzer, South Lyon, MI (US)

(73) Assignee: AMCOR RIGID PACKAGING USA, LLC, Wilmington, DE (US)

( * ) Notice: Subject to any disclaimer, the term of this patent is extended or adjusted under 35 U.S.C. 154(b) by 399 days.

(21) Appl. No.: 14/126,216

(22) PCT Filed: Jun. 14, 2012

(86) PCT No.: PCT/US2012/042373

§ 371 (c)(1),
(2), (4) Date: Dec. 13, 2013

(87) PCT Pub. No.: WO2012/174191

PCT Pub. Date: Dec. 20, 2012

(65) Prior Publication Data

US 2014/0138343 A1 May 22, 2014

Related U.S. Application Data

(60) Provisional application No. 61/496,587, filed on Jun. 14, 2011.

(51) Int. Cl.
*B65D 90/02* (2019.01)
*B65D 1/44* (2006.01)
(Continued)

(52) U.S. Cl.
CPC ..... *B65D 1/44* (2013.01); *B65D 1/0223* (2013.01); *B65D 1/0246* (2013.01); *B65D 1/0261* (2013.01); *B65D 1/40* (2013.01)

(58) Field of Classification Search
CPC ..... B65D 1/44; B65D 1/0223; B65D 1/0246; B65D 1/0261; B65D 1/40; B65D 1/42
(Continued)

(56) References Cited

U.S. PATENT DOCUMENTS

2006/0180568 A1* 8/2006 Lane ..... B65D 79/02 215/384
2010/0006535 A1* 1/2010 Ogg ..... B65D 1/0223 215/384
(Continued)

FOREIGN PATENT DOCUMENTS

JP 2008-056291 A 3/2008
JP 2008056291 * 3/2008 ..... B65D 1/02
JP 2008-133032 A 6/2008

OTHER PUBLICATIONS

International Search Report and Written Opinion of the International Searching Authority for PCT/US2012/042373, dated Jan. 21, 2013; ISA/KR.

*Primary Examiner* — Elizabeth J Volz
(74) *Attorney, Agent, or Firm* — Harness, Dickey & Pierce, P.L.C.

(57) ABSTRACT

A container has a finish, a sidewall portion, a shoulder portion extending between the finish and the sidewall portion, and a base portion extending from the sidewall portion and enclosing the sidewall portion to form a volume therein for retaining a commodity. The sidewall portion includes a label boundary panel and a vacuum panel. The label boundary panel is generally resistant to deflection in response to a vacuum force and defining a surface for receiving a pressure sensitive spot label. The vacuum panel is deflectable in response to the vacuum force. Moreover, the container includes one or more inwardly-directed ribs extending along
(Continued)

the label boundary panel and bound thereby. The inwardly-directed rib(s) generally aid(s) the label boundary panel to resist the vacuum force.

12 Claims, 3 Drawing Sheets

(51) Int. Cl.
*B65D 1/40* (2006.01)
*B65D 1/02* (2006.01)

(58) Field of Classification Search
USPC ..... 215/381, 382, 384, 383; 220/670, 673, 220/675, 669, 721, 666, 672
See application file for complete search history.

(56) References Cited

U.S. PATENT DOCUMENTS

| | | | | |
|---|---|---|---|---|
| 2010/0155360 | A1* | 6/2010 | Mast | B65D 1/0223 215/383 |
| 2011/0049084 | A1* | 3/2011 | Yourist | B65D 1/0246 215/382 |
| 2011/0084046 | A1* | 4/2011 | Schlies | B65D 1/0246 215/381 |
| 2011/0088360 | A1* | 4/2011 | Shah | B65D 1/0223 53/471 |

* cited by examiner

HEAT SET CONTAINER WITH LABEL BOUNDARY PANEL

CROSS-REFERENCE TO RELATED APPLICATIONS

This application claims the benefit of U.S. Provisional Application No. 61/496,587, filed on Jun. 14, 2011. The entire disclosure of the above application is incorporated herein by reference.

FIELD

This disclosure generally relates to containers for retaining a commodity, such as a solid or liquid commodity. More specifically, this disclosure relates to a heat set container having an optimized design structure to facilitate application of one or more spot labels to a generally square-shaped container when viewed through a transverse cross-section.

BACKGROUND

This section provides background information related to the present disclosure which is not necessarily prior art. This section also provides a general summary of the disclosure, and is not a comprehensive disclosure of its full scope or all of its features.

As a result of environmental and other concerns, plastic containers, more specifically polyester and even more specifically polyethylene terephthalate (PET) containers are now being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where ρ is the density of the PET material; ρa is the density of pure amorphous PET material (1.333 g/cc); and ρc is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching an injection molded PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth.

On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 250° F.-350° F. (approximately 121° C.-177° C.), and holding the blown container against the heated mold for approximately two (2) to five (5) seconds. Manufacturers of PET juice bottles, which must be hot-filled at approximately 185° F. (85° C.), currently use heat setting to produce PET bottles having an overall crystallinity in the range of approximately 25% -35%.

SUMMARY

A container is disclosed having a finish, a sidewall portion, a shoulder portion extending between the finish and the sidewall portion, and a base portion extending from the sidewall portion and enclosing the sidewall portion to form a volume therein for retaining a commodity. The sidewall portion includes a label boundary panel and a vacuum panel. The label boundary panel is generally resistant to deflection in response to a vacuum force and defining a surface for receiving a pressure sensitive spot label. The vacuum panel is deflectable in response to the vacuum force. Moreover, the container includes one or more inwardly-directed ribs extending along the label boundary panel and bound thereby. The inwardly-directed rib(s) generally aid(s) the label boundary panel to resist the vacuum force.

Additionally, a container is disclosed that includes a finish and a sidewall portion that is generally square shaped. The sidewall portion has a pair of label boundary panels and a pair of vacuum panels that are circumferentially disposed in an alternating arrangement relative to each other. Each of the label boundary panels are generally resistant to deflection in response to a vacuum force and define a surface for receiving a pressure sensitive spot label. Each of the vacuum panels are deflectable in response to the vacuum force so as to accommodate generally all of the vacuum force. The container also includes a shoulder portion extending between the finish and the sidewall portion. Moreover, the container includes a base portion extending from the sidewall portion and enclosing the sidewall portion to form a volume therein for retaining a commodity.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
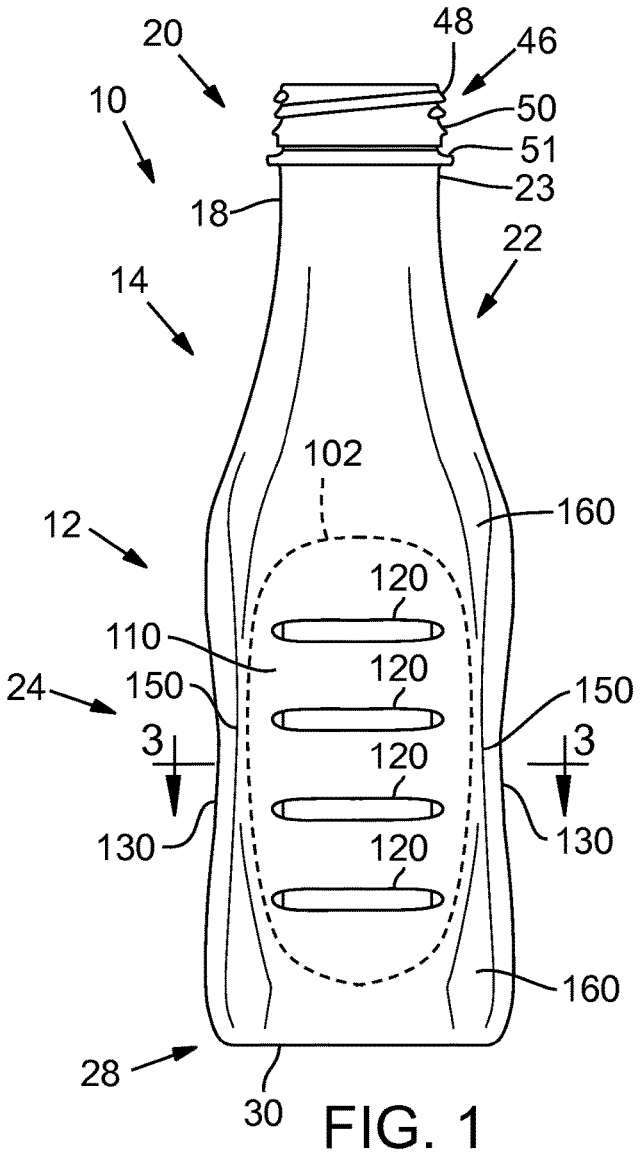
FIG. 1 is a side view of an exemplary container incorporating the features of the present teachings.
Figure 2:
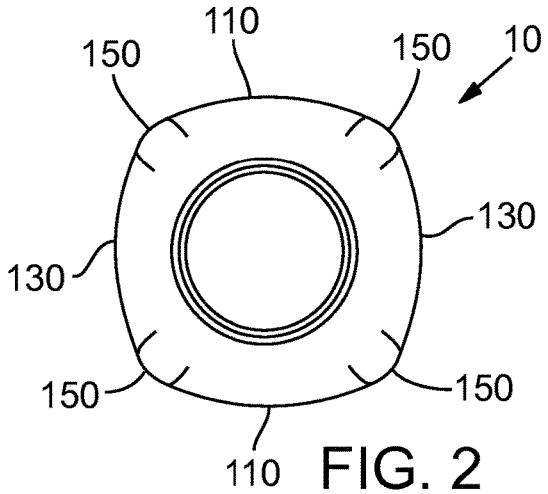
FIG. 2 is a top view of an exemplary container incorporating the features of the present teachings.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

This disclosure provides for a container being made of PET and incorporating a label boundary panel and a vacuum panel having an optimized size and shape that resists container contraction caused by hot fill pressure and results in a container that is particularly suitable for receiving a pressure sensitive spot label.

It should be appreciated that the size and specific configuration of the container may not be particularly limiting and, thus, the principles of the present teachings can be applicable to a wide variety of PET container shapes. Therefore, it should be recognized that variations can exist in the present embodiments. That is, it should be appreciated that the teachings of the present disclosure can be used in a wide variety of containers, including containers having various generally square-shaped transverse cross-sections.

Accordingly, the present teachings provide a plastic, e.g. polyethylene terephthalate (PET), container generally indicated at 10. The exemplary container 10 can be substantially elongated when viewed from a side and generally square-shaped and/or rectangular-shaped when viewed from above or in cross-sections. Those of ordinary skill in the art would appreciate that the following teachings of the present disclosure may be applicable to other containers, such as triangular, pentagonal, hexagonal, octagonal, or polygonal shaped containers, which may have different dimensions and volume capacities. It is also contemplated that other modifications can be made depending on the specific application and environmental requirements.

In some embodiments, container 10 has been designed to retain a commodity. The commodity may be in any form such as a solid or semi-solid product. In one example, a commodity may be introduced into the container during a thermal process, typically a hot-fill process. For hot-fill bottling applications, bottlers generally fill the container 10 with a product at an elevated temperature between approximately 155° F. to 205° F. (approximately 68° C. to 96° C.) and seal the container 10 with a closure before cooling. In addition, the plastic container 10 may be suitable for other high-temperature pasteurization or retort filling processes or other thermal processes as well. In another example, the commodity may be introduced into the container under ambient temperatures.

As shown in FIGS. 1-9, the exemplary plastic container 10 according to the present teachings defines a body 12, and includes an upper portion 14 having a cylindrical sidewall 18 forming a finish 20. Integrally formed with the finish 20 and extending downward therefrom is a shoulder portion 22. The shoulder portion 22 merges into and provides a transition between the finish 20 and a sidewall portion 24. The sidewall portion 24 extends downward from the shoulder portion 22 to a base portion 28 having a base 30. In some embodiments, sidewall portion 24 can extend down and nearly abut base 30, thereby minimizing the overall area of base portion 28 such that there is not a discernable base portion 28 when exemplary container 10 is uprightly-placed on a surface.

The exemplary container 10 may also have a neck 23. The neck 23 may have an extremely short height, that is, becoming a short extension from the finish 20, or an elongated height, extending between the finish 20 and the shoulder portion 22. The upper portion 14 can define an opening for filling and dispensing of a commodity stored therein. Although the container is shown as a beverage container, it should be appreciated that containers having different shapes, such as sidewalls and openings, can be made according to the principles of the present teachings.

The finish 20 of the exemplary plastic container 10 may include a threaded region 46 having threads 48, a lower sealing ridge 50, and a support ring 51. The threaded region provides a means for attachment of a similarly threaded closure or cap (not shown). Alternatives may include other suitable devices that engage the finish 20 of the exemplary plastic container 10, such as a press-fit or snap-fit cap for example. Accordingly, the closure or cap engages the finish 20 to preferably provide a hermetical seal of the exemplary plastic container 10. The closure or cap is preferably of a plastic or metal material conventional to the closure industry and suitable for subsequent thermal processing.

Figure 3:
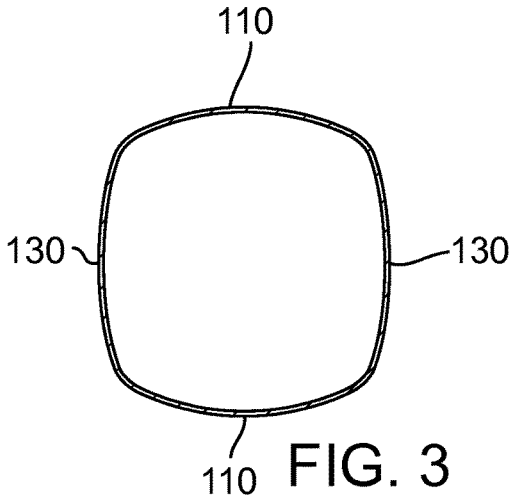
FIG. 3 is a top cross-sectional view of an exemplary container incorporating the features of the present teachings taken along line 3-3 of FIG. 1.
Figure 5:
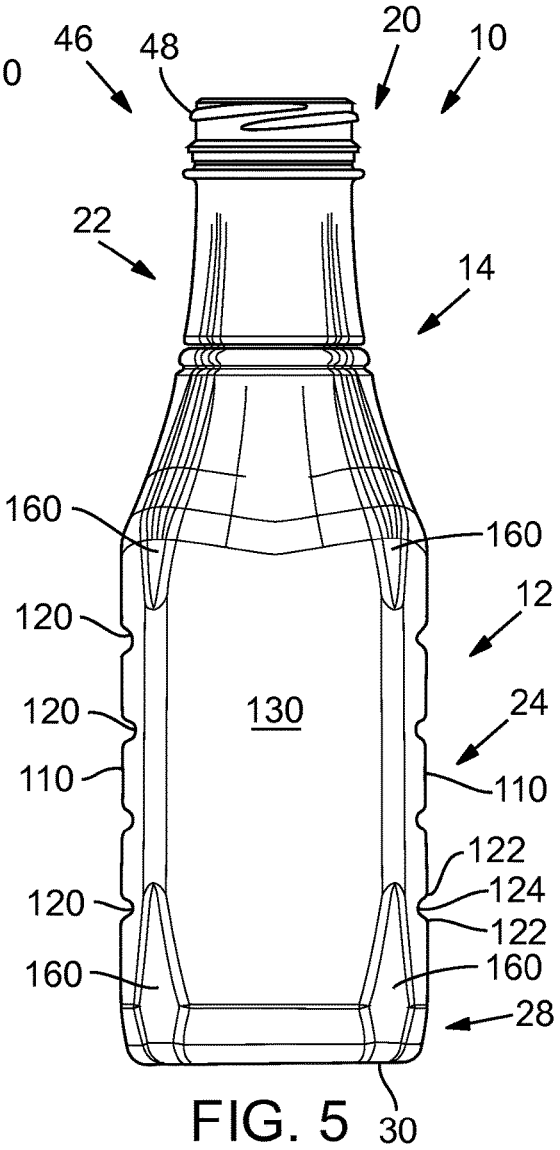
FIG. 5 is a side view of an exemplary container incorporating the features of the present teachings.
Figure 6:
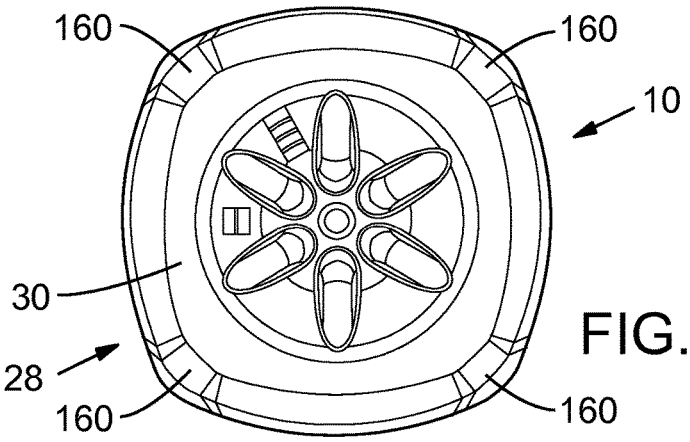
FIG. 6 is a bottom view of an exemplary container incorporating the features of the present teachings.
Figure 7:
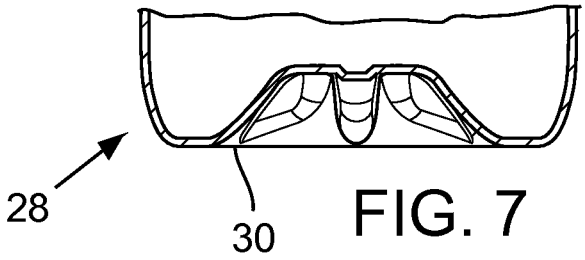
FIG. 7 is a partial cross-sectional view of a base portion of an exemplary container.
Figure 8:
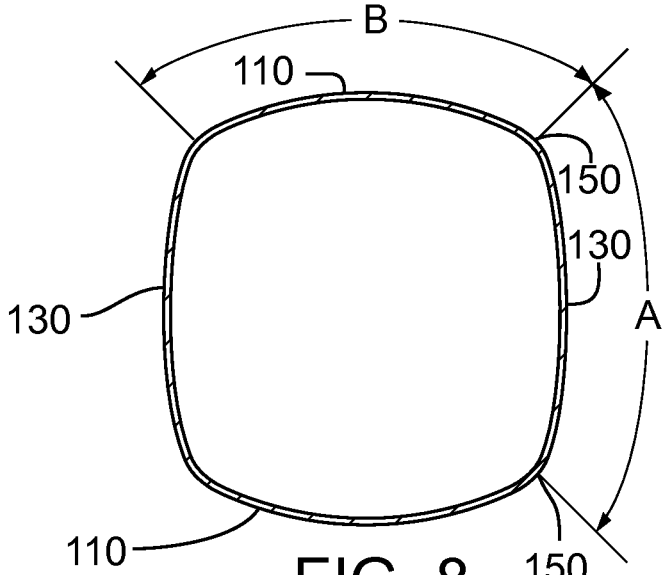
FIG. 8 is a top cross-sectional view of an exemplary container incorporating the features of the present teachings taken along line 8-8 of FIG. 4.
Figure 9:
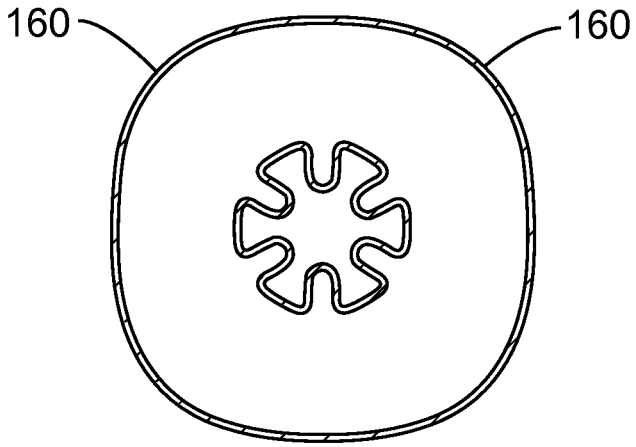
FIG. 9 is a top cross-sectional view of an exemplary container incorporating the features of the present teachings taken along line 9-9 of FIG. 4.

In some embodiments, the container 10 can comprise one or more label boundary panels 110 (such as a pair of label boundary panels 110 on opposing side of container 10) generally disposed along sidewall portion 24. In some embodiments, label boundary panels 110 can be disposed in other portions of the container 10, including the base portion 28 and/or shoulder portion 22. Label boundary panel 110 can comprise a generally uniform cross-sectional profile that generally resists fill pressure and maximizes vacuum absorption without distorting to produce a generally consistent and/or preferential curvature or flatness for application of a pressure sensitive spot label 102, shown in phantom. In some embodiments, as illustrated in FIGS. 3, 5, and 8, label boundary panel 110 can define a generally arcuate cross-sectional profile when viewed from above and can define a generally straight profile when viewed from the side. More particularly, label boundary panel 110 can define a generally convex cross-sectional profile when viewed from above having, for example, a radius of about 58 mm. Generally, as mentioned, label boundary panel 110 can be configured and disposed on opposing sides of container 10. In some embodiments, panel areas 110 can be disposed on opposing sides of a generally rectangular sidewall portion 24 when viewed in cross-section from above.

In some embodiments, each label boundary panel 110 can include a plurality of smaller boundary tiles 112 (FIG. 4) that extend along the outer edge of label boundary panel 110 and serve, at least in part, as a transition surface between adjacent surfaces and label boundary panel 110. It should be appreciated that although label boundary panel 110 is described as having a plurality of boundary tiles 112, each of the plurality of boundary tiles 112 can be smoothly defined so as to seamlessly transition from one to the next to create a generally smooth, flowing, continuous, and uninterrupted label boundary panel 110.

With continued reference to FIGS. 1-9, label boundary panel 110 can further comprise one or more inwardly-directed rib members 120 disposed therein to provide additional structural integrity of label boundary panel 110 to generally resist vacuum forces within container 10. Each of the inwardly-directed rib members 120 can extend horizontally therethrough. Rib members 120 can comprise a generally straight portion extending toward, but separate from, adjacent surfaces (e.g. boundary tiles 112) such that rib members 120 are completely contained within label boundary panel 110. Rib members 120 can be sized to include a pair of inwardly directed surfaces 122 converging at an inner radius 124. One or more terminating ends 126 can be disposed on opposing ends of rib member 120 to provide the necessary structural characteristics and surface transitions. Rib member 120 can be used to reduce and/or otherwise strengthen label boundary panel 110 to prevent or at least minimize expansion/contraction under fill and/or vacuum pressure to provide a surface suitable for pressure sensitive spot labeling. In some embodiments, rib members 120 are parallel and offset from one another.

Still referring to FIGS. 1-9, container 10 can further comprise one or more vacuum panels 130 generally disposed along sidewall portion 24. In some embodiments, vacuum panels 130 are disposed in an alternating fashion relative to label boundary panels 110 such that, in some embodiments, vacuum panels 130 are disposed on opposing sides of container 10. In the exemplary container, a pair of vacuum panels 130 are configured to each move in response to vacuum and/or top loading forces. Additionally, in some embodiments, the vacuum panels 130 can be used as vacuum panels and as grip panels—separately or in combination—as described herein. Still further, in some embodiments, a pair of vacuum panels 130 can together move as a single unit in response to internal vacuum pressure. In some embodiments, as illustrated in FIGS. 1, 3-5, 8, and 9, vacuum panel 130 can define a generally arcuate, convex cross-sectional profile when viewed from above and can define a generally concave profile when viewed from the side. More particularly, vacuum panel 130 can define a generally convex cross-sectional profile when viewed from above having, for example, a radius of about 250 mm. It should be noted that in some embodiments the radius of vacuum panel 130, when viewed from above, is greater than the radius of label boundary panel 110, when viewed from above. More particularly, in some embodiments, the radius of vacuum panel 130, when viewed from above, is about four to six times greater than the radius of the label boundary panel 110, when viewed from above. The increased radius of vacuum panel 130 results in a shorter arc-length A (see FIG. 8) of vacuum panel 130 compared to an arc-length B of label boundary panel 110. The shorter arc-length A of vacuum panel 130 produces enhanced vacuum response to permit vacuum panel 130 to deflect and absorb more of the vacuum force relative to the generally stationary and un-deflected label boundary panel 110.

In this way, vacuum panels 130 are predisposed to accommodate the internal vacuum forces and/or top loading forces to permit label boundary panels 110 to remain substantially (or completely) unchanged in profile. This permits label boundary panels 110 to remain predictably shaped for later pressure sensitive spot labeling.

Figure 4:
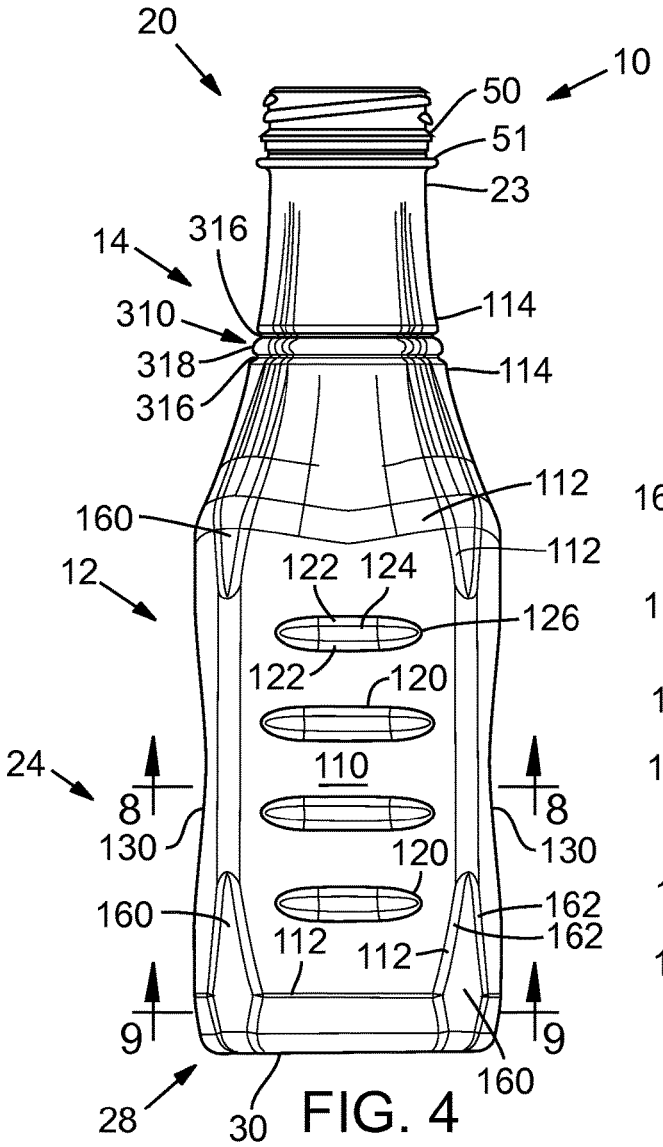
FIG. 4 is a front view of an exemplary container incorporating the features of the present teachings.

With particular reference to FIGS. 1, 4, and 5, in some embodiments, container 10 comprises columns 150 disposed between adjacent label boundary panels 110 and vacuum panels 130. Columns 150 extend vertically between label boundary panel 110 and vacuum panel 130. In some embodiments, columns 150 can define a transition surface, such as a radiused surface, that serves to provide an aesthetic transition therebetween and further provides improved structural integrity and resistance to top loading forces. Moreover, columns 150, in some embodiments, serve as a hinge point to permit isolated deflection of vacuum panels 130 without causing unwanted deflection of label boundary panels 110.

Columns 150 can terminate at opposing top and bottom ends as chamfer surfaces 160. Chamfer surfaces 160 serve to provide a transition surface between label boundary panels 110, vacuum panels 130, columns 150 and shoulder portion 22 or base portion 28. Chamber surfaces 160 can further be bound by one or more boundary tiles 162 (FIG. 4).

With particular reference to FIGS. 4-5, container 10 can further comprise one or more inwardly-directed, circumferential ribs 310. In some embodiments, circumferential rib 310 can be disposed within shoulder portion 22, between or generally along an interface between shoulder portion 22 and sidewall portion 24, between or generally along an interface between base portion 28 and sidewall portion 24, or both.

Circumferential ribs 310 can be formed to have a pair of inward radiused sections 316 for improved structural integrity and extending outwardly along a corresponding outward radiused section 318 to merge with adjacent lands 114, which can itself include various features and contours. Through their structure, circumferential ribs 310 are capable of resisting the force of internal pressure by acting as a "belt" that limits the "unfolding" of the cosmetic geometry of the container that makes up the exterior design.

The plastic container 10 of the present disclosure is a blow molded, biaxially oriented container with a unitary construction from a single or multi-layer material. A well-known stretch-molding, heat-setting process for making the one-piece plastic container 10 generally involves the manufacture of a preform (not shown) of a polyester material, such as polyethylene terephthalate (PET), having a shape well known to those skilled in the art similar to a test-tube with a generally cylindrical cross section. An exemplary method of manufacturing the plastic container 10 will be described in greater detail later.

An exemplary method of forming the container 10 will be described. A preform version of container 10 includes a support ring 51, which may be used to carry or orient the preform through and at various stages of manufacture. For example, the preform may be carried by the support ring, the support ring may be used to aid in positioning the preform in a mold cavity, or the support ring may be used to carry an intermediate container once molded. At the outset, the preform may be placed into the mold cavity such that the support ring is captured at an upper end of the mold cavity. In general, the mold cavity has an interior surface corresponding to a desired outer profile of the blown container. More specifically, the mold cavity according to the present teachings defines a body forming region, an optional moil forming region and an optional opening forming region. Once the resultant structure, hereinafter referred to as an intermediate container, has been formed, any moil created by the moil forming region may be severed and discarded. It should be appreciated that the use of a moil forming region and/or opening forming region are not necessarily in all forming methods.

In one example, a machine (not illustrated) places the preform heated to a temperature between approximately 190° F. to 250° F. (approximately 88° C. to 121° C.) into the mold cavity. The mold cavity may be heated to a temperature between approximately 250° F. to 350° F. (approximately 121° C. to 177° C.). A stretch rod apparatus (not illustrated) stretches or extends the heated preform within the mold cavity to a length approximately that of the intermediate container thereby molecularly orienting the polyester material in an axial direction generally corresponding with the central longitudinal axis of the container 10. While the stretch rod extends the preform, air having a pressure between 300 PSI to 600 PSI (2.07 MPa to 4.14 MPa) assists in extending the preform in the axial direction and in expanding the preform in a circumferential or hoop direction thereby substantially conforming the polyester material to the shape of the mold cavity and further molecularly orienting the polyester material in a direction generally perpendicular to the axial direction, thus establishing the biaxial molecular orientation of the polyester material in most of the intermediate container. The pressurized air holds the mostly biaxial molecularly oriented polyester material against the mold cavity for a period of approximately two (2) to five (5) seconds before removal of the intermediate container from the mold cavity. This process is known as heat setting and results in a heat-resistant container suitable for filling with a product at high temperatures.

Alternatively, other manufacturing methods, such as for example, extrusion blow molding, one step injection stretch blow molding and injection blow molding, using other conventional materials including, for example, high density polyethylene, polypropylene, polyethylene naphthalate (PEN), a PET/PEN blend or copolymer, and various multilayer structures may be suitable for the manufacture of plastic container 10. Those having ordinary skill in the art will readily know and understand plastic container manufacturing method alternatives.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A container comprising:

a finish;

a sidewall portion having a label boundary panel and a vacuum panel, said label boundary panel being generally resistant to deflection in response to a vacuum force and defining a surface for receiving a pressure sensitive spot label, said vacuum panel including a concave surface having a vertex at a midpoint of a length of the vacuum panel when viewed from a side such that the concave surface curves inward to the vertex both above and below the midpoint, and the vacuum panel being convex when viewed in cross-section such that said vacuum panel is deflectable in response to said vacuum force;

a vertical column disposed between said label boundary panel and said vacuum panel;

a pair of chamfer surfaces each extending on opposing ends of said vertical column, each of said pair of chamfer surfaces providing a transition surface between at least a portion of said label boundary panel, said vacuum panel, and said vertical column;

a shoulder portion extending between said finish and said sidewall portion;

a base portion extending from said sidewall portion and enclosing said sidewall portion to form a volume therein for retaining a commodity; and one or more inwardly-directed ribs extending along said label boundary panel and bound thereby, said inwardly-directed rib generally aiding said label boundary panel to resist said vacuum force;

wherein a cross-sectional radius of said vacuum panel is at least four times greater than a cross-sectional radius of said label boundary panel.

2. The container according to claim 1 wherein said label boundary panel is generally flat when viewed from a first direction and generally convex when viewed from a second direction, said second direction being orthogonal to said first direction.

3. The container according to claim 1 wherein said label boundary panel is flat when viewed from a side and convex when viewed in cross-section.

4. The container according to claim 1 wherein an arc length of said label boundary panel is greater than an arc length of said vacuum panel.

5. The container according to claim 1 wherein said vertical column defines a radius between said label boundary panel and said vacuum panel.

6. The container according to claim 1 wherein said one or more inwardly-directed ribs includes a pair of inwardly-directed surfaces converging at an inner radius.

7. A container comprising:

a finish;

a sidewall portion being generally square shaped, said sidewall portion having a pair of label boundary panels and a pair of vacuum panels being circumferentially disposed in an alternating arrangement relative to each other, each of said label boundary panels being generally resistant to deflection in response to a vacuum force and defining a surface for receiving a pressure sensitive spot label, each of said vacuum panels including a concave surface having a vertex at a midpoint of a length of the vacuum panels when viewed from a side such that the concave surfaces curve inward to the vertex both above and below the midpoint, and the vacuum panels being convex when viewed in cross-section such that each of said vacuum panels is deflectable in response to said vacuum force so as to accommodate generally all of said vacuum force;

a vertical column disposed between each of said label boundary panels and each of said vacuum panels;

a pair of chamfer surfaces each extending on opposing ends of said vertical column, each of said pair of chamfer surfaces providing a transition surface between at least a portion of said label boundary panel, said vacuum panel, and said vertical column;

a shoulder portion extending between said finish and said sidewall portion; and a base portion extending from said sidewall portion and enclosing said sidewall portion to form a volume therein for retaining a commodity;

wherein a cross-sectional radius of each of said vacuum panels is at least four times greater than a cross-sectional radius of each of said label boundary panels.

8. The container according to claim 7, further comprising:

one or more inwardly-directed ribs extending horizontally along each of said label boundary panels and bound thereby, said inwardly-directed rib generally aiding each of said label boundary panels to resist said vacuum force.

9. The container according to claim 7 wherein each of said label boundary panels is generally flat when viewed from a first direction and generally convex when viewed from a second direction, said second direction being orthogonal to said first direction.

10. The container according to claim 7 wherein each of said label boundary panels is flat when viewed from a side and convex when viewed in cross-section.

11. The container according to claim 7 wherein an arc length of each of said label boundary panels is greater than an arc length of each of said vacuum panels.

12. The container according to claim 7, wherein said vertical column defines a radius between each of said label boundary panels and each of said vacuum panels.

* * * * *